US009419324B2

(12) United States Patent
Hsue et al.

(10) Patent No.: US 9,419,324 B2
(45) Date of Patent: Aug. 16, 2016

(54) DELAY LINE HAVING PLURAL OPEN STUBS AND COMPLEMENTARY SLOTS ARRANGED TO HAVE PARALLEL PORTIONS AND NON-PARALLEL PORTIONS

(71) Applicants: Ching-Wen Hsue, Taichung (TW); Thomas Hsue, Taichung (TW)

(72) Inventors: Ching-Wen Hsue, Taichung (TW); Thomas Hsue, Taichung (TW)

( * ) Notice: Subject to any disclaimer, the term of this patent is extended or adjusted under 35 U.S.C. 154(b) by 0 days.

(21) Appl. No.: 14/156,348

(22) Filed: Jan. 15, 2014

(65) Prior Publication Data

US 2015/0200438 A1 Jul. 16, 2015

(51) Int. Cl.

| | |
|---|---|
| ***H01P 9/00*** | (2006.01) |
| ***H01P 1/18*** | (2006.01) |
| *H01P 3/08* | (2006.01) |

(52) U.S. Cl.

CPC *H01P 9/00* (2013.01); *H01P 1/184* (2013.01); *H01P 3/081* (2013.01)

(58) Field of Classification Search

CPC ..... H01P 9/00; H01P 9/006; H01P 1/18; H01P 1/184

USPC ..... 333/161

See application file for complete search history.

(56) References Cited

U.S. PATENT DOCUMENTS

| | | | | |
|---|---|---|---|---|
| 2009/0195327 | A1* | 8/2009 | Cho et al. | 333/34 |
| 2011/0090028 | A1* | 4/2011 | Park et al. | 333/238 |
| 2013/0076453 | A1* | 3/2013 | Lai et al. | 333/161 |

* cited by examiner

*Primary Examiner* — Benny Lee

(74) *Attorney, Agent, or Firm* — Guice Patents PLLC

(57) ABSTRACT

A basic cell of a microwave group delay line is disclosed for tuning the electromagnetic signal propagation delay time from signal source (1) to output (5), wherein two pairs of unequal-length stubs (($L_{1b}$, $L_{1b}$), ($L_{2b}$, $L_{2b}$)) are placed on both sides of the main transmission path (2) in the signal layer and two pairs of complementary slot-lines (($L_{1t}$, $L_{1t}$), ($L_{2t}$, $L_{2t}$)) are placed on both sides of the main transmission path (2) in ground plane for microstrip structure. Unequal-length stubs are placed in central layer and complementary slot-lines are placed in either outer conductor ground planes for strip-line structure. The characteristic impedances ($Z_0$, $2Z_{1b}$, $2Z_{2b}$, $2Z_{1t}$, $2Z_{2t}$) of transmission paths are selected to control group delay time and minimize reflection of signals from signal source to output. A cascade connection of the basic cell forms a delay line system.

6 Claims, 5 Drawing Sheets

DELAY LINE HAVING PLURAL OPEN STUBS AND COMPLEMENTARY SLOTS ARRANGED TO HAVE PARALLEL PORTIONS AND NON-PARALLEL PORTIONS

BACKGROUND OF THE INVENTION

1. Field of the Invention

This invention relates to a technique for implementing a dispersive group delay line for the electromagnetic signal.

2. Description of the Related Art

Group delay has been a subject of interest in electromagnetic communications, wherein the transmission paths are required to have flat group delay in the pass-bands. For example, a band-pass filter based on conventional Chebyshev, Butterworth or elliptic method has a flat group delay in the pass-band and it has larger group delay near the edges of the pass-band. However, the larger group delay response outside of the pass-band is of no particular consequence in most cases. As a result, most of efforts focused on the flat group delay in the microwave components study. Unfortunately, electromagnetic communication channels suffer strong group delay variation in air or other transmission paths and the time domain waveforms become distorted when impulse signals are considered. The group delay line can be used to minimize the distortion effect.

Dispersive delay lines using conventional all-pass technology experience small group delay time. A cascade connection of all-pass delay units improves the overall response in the sense of obtaining larger group delay time. However, it increases the circuit area as well as transmission losses. Although surface acoustic wave devices are compact and provide large delays, their applications are limited to low-frequency and narrow-bandwidth applications. Therefore, there is a need for a technique for implementing a group delay line with larger frequency-sensitive delay time, low-loss response for wide-bandwidth applications.

SUMMARY OF THE INVENTION

Briefly, in accordance with the invention, a group-delay network is provided for tuning the propagation delay time of designated signal frequencies from a source to an output load. The basic cell of the group delay device comprises a main transmission path that is connected to the source and the output at two ends of the transmission path, a couple of pairs of unequal-length, parallel, open stubs, a couple of pairs of complementary slot lines. The pairs of unequal-length, parallel stubs are directly connected to the main transmission path, wherein one pair of stubs are different from another pair of stubs in the sense of electric length $\theta_i$ (i=1, 2). In other words, two electric (and physical) lengths of stubs are different from each other, as shown in FIG. 1, and $\theta_1 \neq \theta_2$. The pair of stubs ($2Z_{1b}$, $2Z_{1b}$) is referred to as unequal in length to the pair of stubs ($2Z_{2b}$, $2Z_{2b}$), which are also shown in FIGS. 2 and 4. Two pairs of complementary slot lines are corresponding to the characteristics of two pairs of unequal-length, open stubs, respectively, which are omitted in FIG. 1. $Z_S$ and $Z_L$ in FIG. 1 are source and load impedances and (1) and (5) are surface end and output load, respectively, and $Z_0$ is the impedance of a main line, which is also shown in FIG. 2. Two pairs of unequal-length, parallel stubs are employed to generate a pass-band lying between two stop-bands. The maximum transmission coefficient in the pass-band, which is bounded by two transmission nulls in the frequency band, is determined by the following relationship $$Z_{1b}\cot\theta_1+Z_{2b}\cot\theta_2=0. \tag{1}$$

The maximum group delay $G_d$ in the pass-band is $$G_d \approx 2T_o \frac{Z_o}{Z_{1b}Z_{2b}/(Z_{1b}+Z_{2b})}\frac{1}{\delta_o^2}, \tag{2}$$

where $T_0$ is the propagation delay time for the signal traveling across one of unequal-length stubs, and $\delta_0$ is the normalized bandwidth of the pass-band.

In a preferred embodiment, the group delay is determined by the propagation delay time of each one of the unequal-length stubs, the normalized pass-band band-width and characteristic impedances of both main transmission path and unequal-length stubs.

In applications where group delays of certain bands of high-frequency signals are to be tuned, the present invention can be realized on a printed circuit board. For the main transmission path and two pairs of unequal-length, parallel stubs, each element is fabricated in changing the conductor strip width and length of the element. For the complementary slot line, the conductor is removed from the ground conductor plane to form the strip-like non-conductor strip. The complementary slot line is placed just beneath the corresponding stub, and the stub is separated from the complementary slot line with the insulating dielectric substrate.

DETAILED DESCRIPTION OF THE PREFERRED EMBODIMENT

Figure 1:
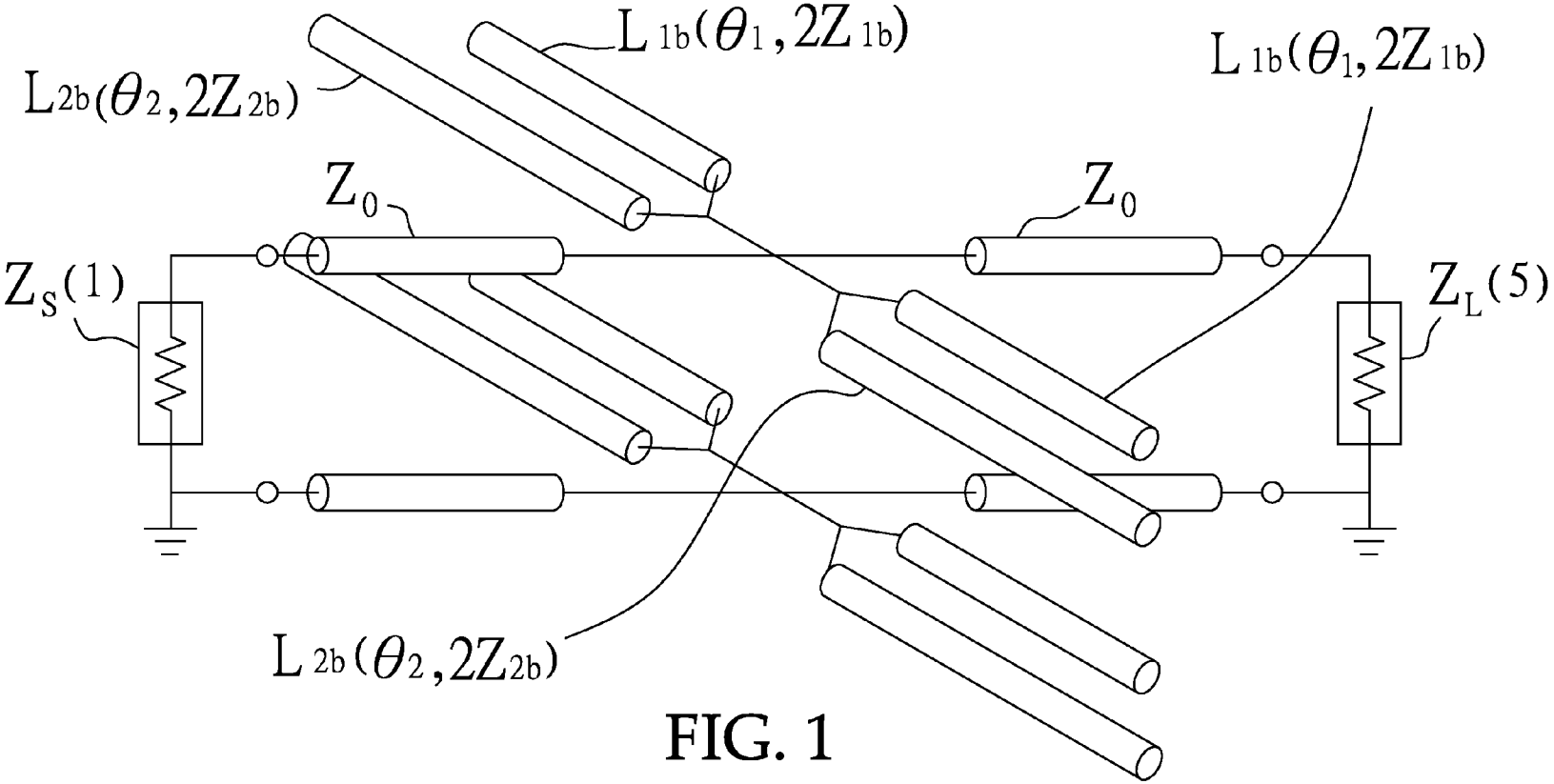
FIG. 1 Prior Art
FIG. 1 shows the equivalent transmission line representation of the basic cell of a group delay line.
Figure 2:
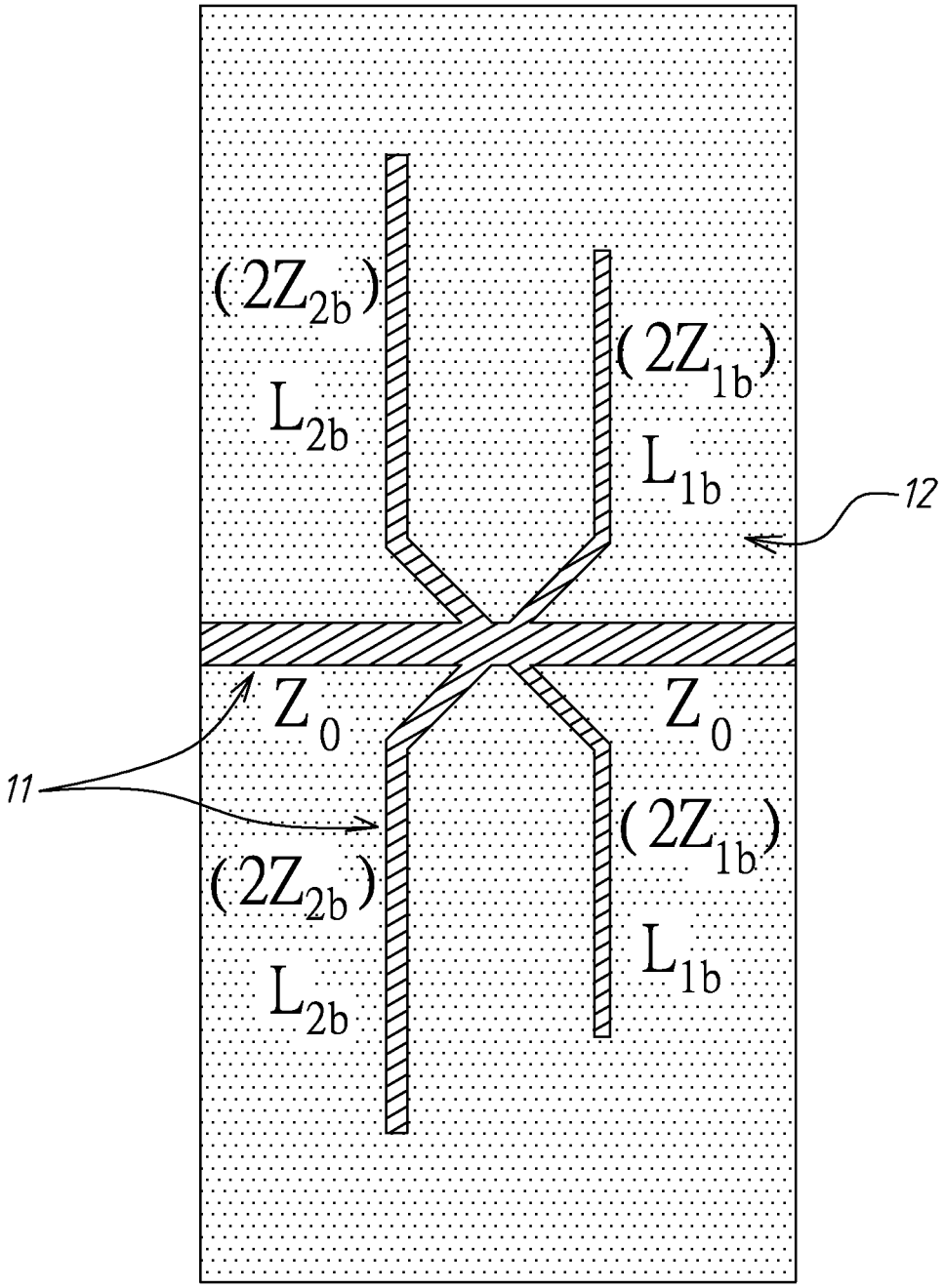
FIG. 2 shows a schematic drawing of unequal-length stubs of basic cell in the top signal layer.
Figure 3:
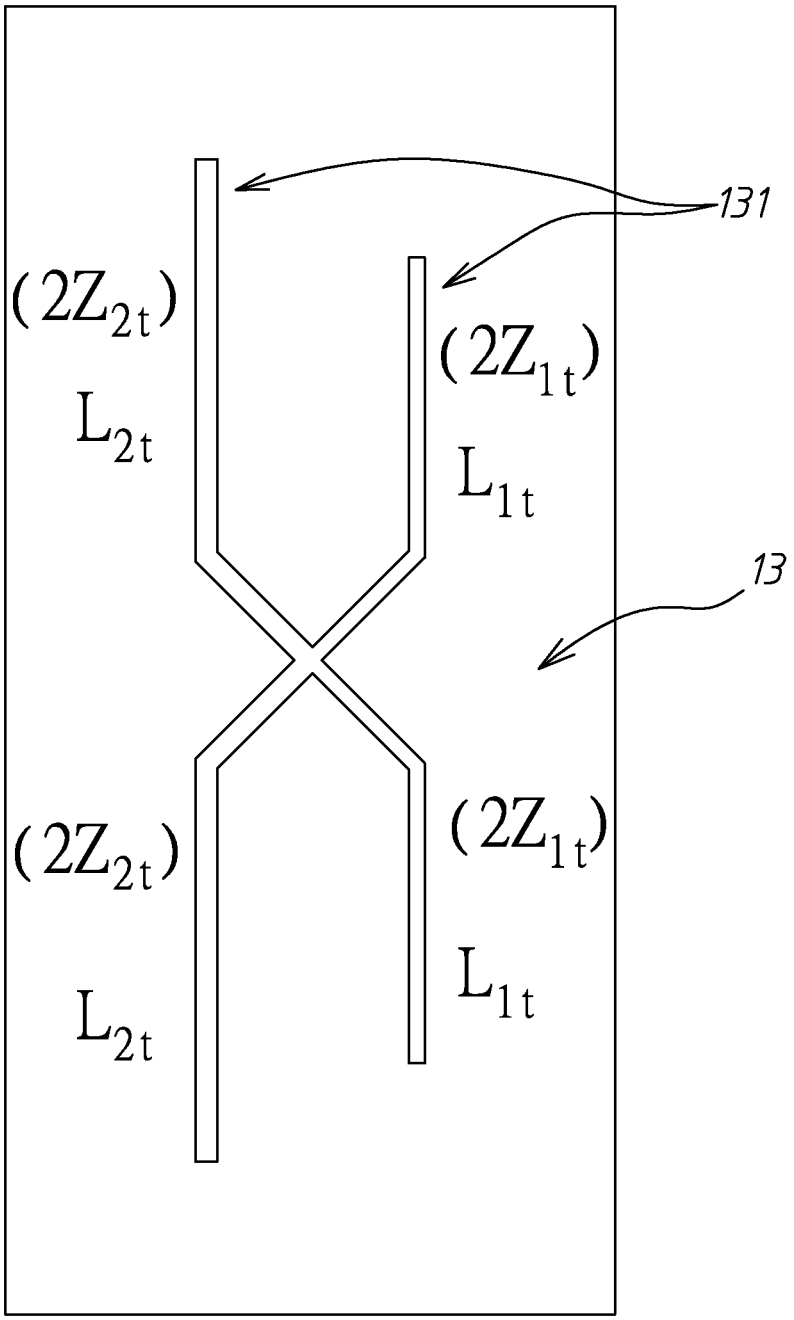
FIG. 3 shows a schematic drawing of unequal-length complementary slot lines of basic cell in the bottom ground layer.
Figure 4:
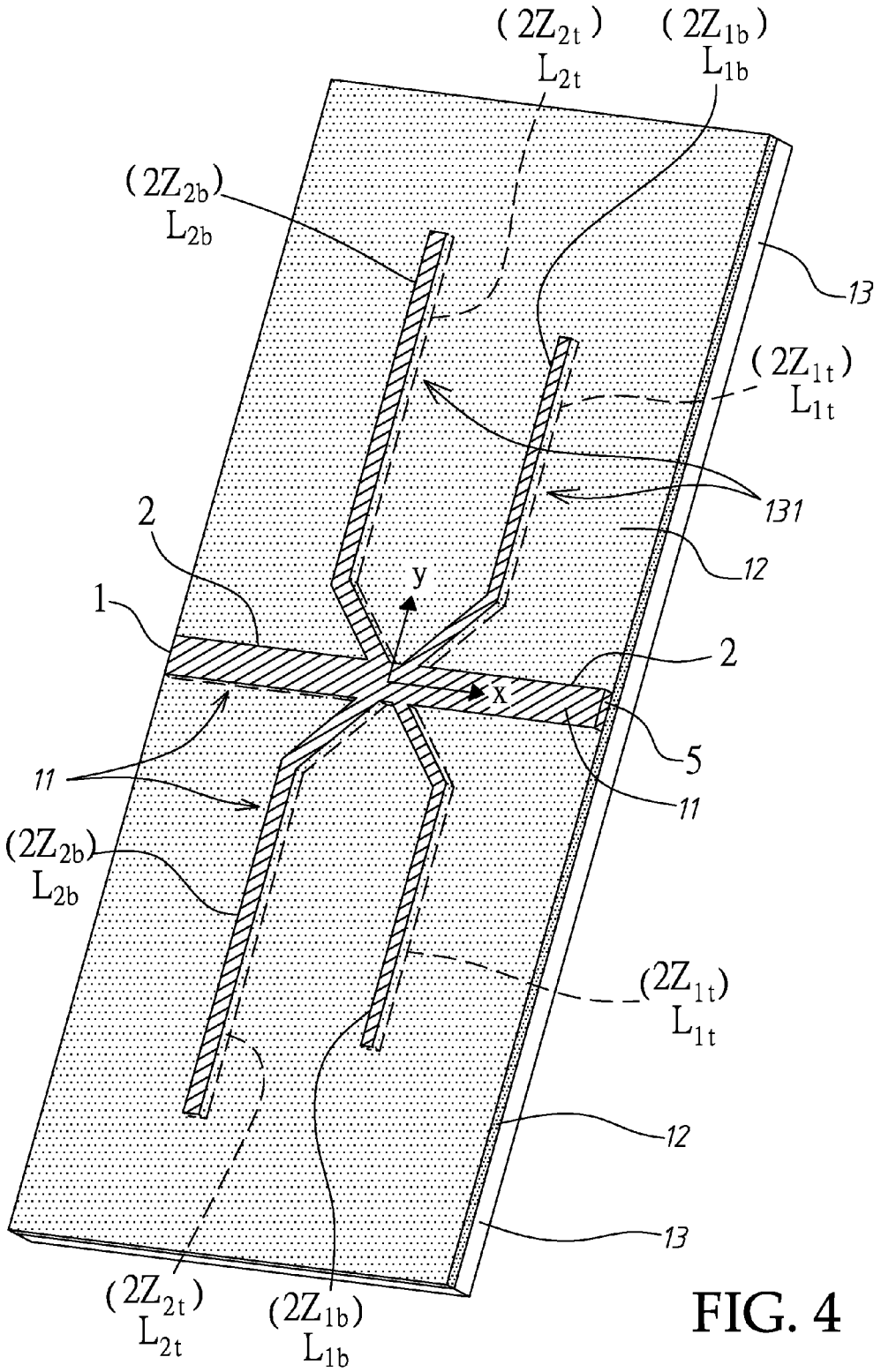
FIG. 4 shows a three-dimension schematic drawing of basic cell of a group delay line.

To appreciate the details of the present invention, as shown in FIGS. 2-5, a general understanding of transmission lines will prove helpful. In this regard, reference should be made to FIG. 1 for the basic cell of the group delay line, where (the drawing is a conventional, prior to art transmission line,) $2Z_{ib}$ (i=1, 2) is the characteristic impedance, $\beta_{ib}$ is the propagation constant, and $l_{ib}$ is the physical length of transmission line. The electric lengths of open stubs $2Z_{1b}$ and $2Z_{2b}$ are unequal, i.e., $\theta_1=\beta_{1b}l_{1b}\neq\beta_{2b}l_{2b}=\theta_2$, or $l_{1b}\neq l_{2b}$ when $\beta_{1b}=\beta_{2b}$. The lengths $L_{1b}$ and $L_{2b}$ in FIG. 2 are used to represent $l_{1b}$ and $l_{2b}$, respectively. In the following discussion, the equivalent characteristic impedance of parallel stubs ($2Z_{ib}$, $2Z_{ib}$) is changed to $Z_{ib}$ so as to simplify the mathematical representation. Referring to FIGS. 1 to 5, a group delay network is depicted. The group delay network connects a source end (the element $Z_S$ of FIG. 1 and the signal source end 1 of FIG. 4) and an output load end (the element $Z_L$ of FIG. 1 and the load end 5 of FIG. 4). In this embodiment, the microstrip structure of the invention includes a main signal transmission path 2 (FIG. 4), a source end 1 (FIG. 4), an output load 5 (FIG. 4), a signal layer 11 (FIGS. 2, 4), an insulating layer 12 (FIGS. 2, 4), a ground layer 13 (FIGS. 3, 4), slot lines 131 (FIGS. 3, 4), and main line $Z_0$. The group delay device includes the main signal transmission path 2 for the input signal and output signal, two pairs of unequal-length, open stubs (($L_{1b}$, $L_{1b}$), ($L_{2b}$, $L_{2b}$)) placed on two sides of the main signal transmission path 2 (FIGS. 1, 2, 4), two pairs of unequal-length, complementary slot lines (($L_{1t}$, $L_{1t}$), ($L_{2t}$, $L_{2t}$)) that are placed in the ground plane of the microstrip structure, as shown in FIGS. 3, 4. As shown in FIGS. 2, 3, and 4, each of the open stubs (($L_{1b}$, $L_{1b}$), ($L_{2b}$, $L_{2b}$)) and each of the complementary slot lines (($L_{1t}$, $L_{1t}$), ($L_{2t}$, $L_{2t}$)) has a parallel portion and a non-parallel portion. Each parallel portion of the open stubs (($L_{1b}$, $L_{1b}$), ($L_{2b}$, $L_{2b}$)) and the complementary slot lines (($L_{1t}$, $L_{1t}$), ($L_{2t}$, $L_{2t}$)) has an unequal-length. Each non-parallel portion of the open stubs (($L_{1b}$, $L_{1b}$), ($L_{2b}$, $L_{2b}$)) and the complementary slot lines (($L_{1t}$, $L_{1t}$), ($L_{2t}$, $L_{2t}$)) cross and are connected at a same location. Each open stub is uniform, non-uniform or meandered along the line and each complementary slot line is uniform, non-uniform or meandered. Each of the open stubs (($L_{1b}$, $L_{1b}$), ($L_{2b}$, $L_{2b}$)) located on the insulating layer 12 corresponds to one of the complementary slot lines (($L_{1t}$, $L_{1t}$), ($L_{2t}$, $L_{2t}$)) located on ground layer 13 forming a multiple layer structure.

The input impedance $Z_{in,i}$ looking from the main line $Z_0$ toward each of the open stub is $$Z_{in,i}=jZ_i\cot(\beta_{ib}l_{ib}),\ (i=1,2). \tag{3}$$

When one of the physical lengths $l_{ib}$ is equal to a quarter guided wavelength, the input impedance $Z_{in,i}$ is zero. As a result, a transmission zero occurs. When the open stub is smaller than a quarter guided wave-length, the open stub appears to be capacitive. On the other hand, if the open stub is larger than a quarter guided wave-length, it is inductive. When two parallel stubs with different physical lengths are implemented, two transmission zeros occur at two respective frequencies. At a frequency located between two transmission-zero frequencies, one $Z_{in,i}$ (i=1,2) is inductive and another is capacitive. When $Z_{in,1}+Z_{in,2}=0$, the total input impedance due to two parallel stubs is infinite, and a total transmission through the main line occurs. As a result, a pass-band is provided between two transmission nulls. The pass-band exhibits excessive group delay.

For the circuit shown in FIG. 1, the scattering parameter $S_{21}$ (or transmission coefficient) is as follows $$S_{21}=\left[\frac{2Z_{in}}{Z_{in}+Z_o}\right], \tag{4}$$

where $$Z_{in}=\left[\frac{1}{\frac{1}{Z_o}+\frac{1}{Z_{in,1}}+\frac{1}{Z_{in,2}}}\right]. \tag{5}$$

Substituting both (3) and (5) into (4), we obtain the transmission coefficient $S_{21}$ $$S_{21}=\frac{1}{1+j\frac{Z_o(Z_{1b}\cot\theta_1+Z_{2b}\theta_2)}{2Z_{1b}Z_{2b}\cot\theta_1\cot\theta_2}}, \tag{6}$$

where $\theta_i\beta_{ib}l_{ib}$ (i=1,2).

The complex scattering parameter $S_{21}$ can be expressed in the polar form as $S_{21}=|S_{21}|\angle S_{21}$. $\angle S_{21}$ is the argument of $S_{21}$ and it is given as follows $$\angle S_{21}=-\Pi-\tan^{-1}\left[\frac{Z_o(Z_{1b}\cot\theta_1+Z_{2b}\cot\theta_2)}{2Z_{1b}Z_{2b}\cot\theta_1\cot\theta_2}\right]. \tag{7}$$

As stated above, a pass-band is lying between two transmission nulls caused by parallel stubs. The group delay $G_d$ of the basic cell is defined as $$G_d=-\frac{d\angle S_{21}}{d\varpi}, \tag{8}$$

where ω is the angular frequency of signal. The group delay $G_d$ is determined by characteristic impedance $Z_{ib}$(i=1,2), and electrical length $\theta_i$ of transmission lines. Upon the substitution of (7) into (8), we obtain $$G_d=\frac{Z_oZ_{1b}Z_{2b}\{A-B\}}{2Z_{1b}^2Z_{2b}^2\cot^2\theta_1\cot^2\theta_2+2Z_o^2(Z_{1b}\cot\theta_1+Z_{2b}\cot\theta_2)^2}, \tag{9}$$

where $$A=(Z_{1b}\cot\theta_1+Z_{2b}\cot\theta_2)[(\cot\theta_2+\cot^2\theta_1\cot\theta_2)T_1+\cot\theta_1+\cot^2\theta_2\cot\theta_1)T_2], \tag{9a}$$

and $$B=(Z_{1b}T_1+T_{2b}T_2+T_{1b}T_1\cot^2\theta_1+Z_{2b}T_2\cot^2\theta_2)\cot\theta_1\cot\theta_2. \tag{9b}$$

$T_1$ and $T_2$ in (9a) and (9b) are propagation delay time for signal traveling across lines $l_{1b}$ and $l_{2b}$, respectively, i.e., $d\theta_i/d\omega=T_i$ (i=1,2). The maximum group delay occurs at the total transmission frequency. Substituting $Z_{1b}\cot\theta_1+Z_{2b}\cot\theta_2=0$ into (9), to obtain $$G_d=\frac{-Z_o}{2Z_{1b}Z_{2b}\cot\theta_1\cot\theta_2}[Z_{1b}(1+\cot^2\theta_1)T_1+Z_{2b}(1+\cot^2\theta_2)T_2]. \tag{10}$$

To extract the physical insight regarding the maximum group delay of this dispersive transmission line, we further simplify its mathematical expressions. A transmission-zero frequency occurs when the physical length of a stub is a quarter guided wavelength. The electrical lengths of two stubs at the total-transmission frequency of the pass-band can thus be set as follows $$\theta_1=\pi/2-\delta_1,\ \theta_2=\pi/2+\delta_2. \tag{11}$$

$\delta_i$ (i=1,2) is the electrical length distance in radian between the electrical length at the total transmission frequency of the pass-band and the electrical length at the transmission null frequency caused by the respective stub. If it is assumed that $\delta_1=\delta_2=\delta$, (10) is further simplified to the following $$G_d=\frac{Z_o[(Z_{1b}T_2+T_{2b}T_1)(1+\tan^2\delta)]}{2Z_{1b}Z_{2b}\tan^2\delta}. \tag{12}$$

For narrow pass-band $\tan\delta\cong\delta$ and an $^2\delta<<1$. Under such a condition, the group delay $G_d$ in (12) now becomes as follows $$G_d\approx\frac{Z_o}{2Z_{1b}Z_{2b}\delta^2}[Z_{1b}T_1+Z_{2b}T_2]. \tag{13}$$

Notice that $T_i$ (i=1, 2) is the propagation delay time for the signal traveling across the stub line. If we assume that $\delta_1=\delta_2=\delta_0/2$ and $T_1=T_2=T_0$, (13) can be simplified further to the following $$G_{d,narrowband} \approx 2T_o \frac{Z_o}{Z_{1b}Z_{2b}/(Z_{1b}+Z_{2b})} \frac{1}{\delta_o^2}, \tag{14}$$

where $T_0$ is the propagation delay time across a quarter guided wavelength and $\delta_0$ is the normalized bandwidth between two transmission nulls caused by two stubs.

Figure 5:
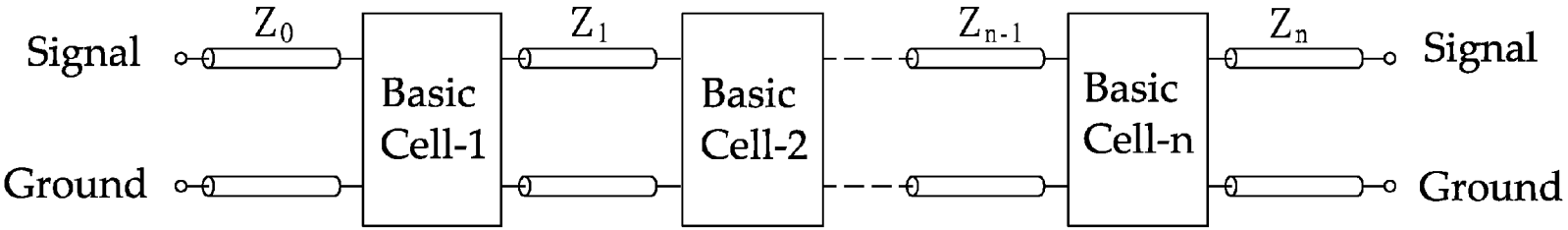
FIG. 5 shows the cascade connection of basic cells of the group delay line network in accordance with the present invention.

As shown in FIG. 5, a cascade connection of the basic cells (BasicCell-1, BasicCell-2, . . . BasicCell-N) using segments $Z_0, Z_1, \ldots, Z_{n-1}, Z_n$ (n is a positive integer) to form a group delay line system between signal and ground.

The introduction of complementary slot lines is to transform the induced, band-limited pass-band to an all pass-band, which is $|S_{21}|=1$. $L_{1t}$ and $L_{2t}$ in FIG. 3 FIGS. 3 and 4 are the lengths of complementary slot lines $2Z_{1t}$ and $2Z_{2t}$, respectively.

The three-dimension schematic drawing of basic cell of a group delay line in FIG. 4 is a three-layers structure, where (11) is the signal (top) layer, (12) is the insulating (middle) layer, and (13) is the conductor ground (bottom) layer.

What is claimed is:

1. A basic cell consisting of a plurality of multiple pairs of open stubs and multiple pairs of complementary slot lines being non-parallel, wherein said multiple pairs of open stubs $((L_{1b}, L_{1b}), \ldots, (L_{nb}, L_{nb}))$ (n is a positive integer) are printed conductor wires in a signal layer of a printed circuit board, and the multiple pairs of complementary slot lines $((L_{1t}, L_{1t}), \ldots, (L_{nt}, L_{nt}))$ are line areas in ground planes, where the conductor of the ground planes is removed;

wherein each open stub of the multiple pairs of said open stubs $((L_{1b}, L_{1b}), (L_{2b}, L_{2b}))$ is associated with a corresponding complementary slot line of the multiple pairs of said complementary slot lines $((L_{1t}, L_{1t}), (L_{2t}, L_{2t}))$ thereby forming a multilayer structure;

wherein each of the multiple pairs of said open stubs $((L_{1b}, L_{1b}), (L_{2b}, L_{2b}))$ and each of the multiple pairs of said complementary slot lines $((L_{1t}, L_{1t}), (L_{2t}, L_{2t}))$ has a parallel portion and a non-parallel portion, each parallel portion of the multiple pairs of said open stubs $((L_{1b}, L_{1b}), (L_{2b}, L_{2b}))$ and the multiple pairs of said complementary slot lines $((L_{1t}, L_{1t}), (L_{2t}, L_{2t}))$ has an unequal-length; each non-parallel portion of the multiple pairs of said open stubs $((L_{1b}, L_{1b}), (L_{2b}, L_{2b}))$ and the multiple pairs of said complementary slot lines $((L_{1t}, L_{1t}), (L_{2t}, L_{2t}))$ cross and are connected at a same location.

2. A basic cell for tuning the signal propagation delay time of a signal propagating from a source end (1) to an output load (5), consisting of a main signal transmission path (2) connected between the source end and the output load, two pairs of unequal-length, open stubs $((L_{1b}, L_{1b}), (L_{2b}, L_{2b}))$ placed on two sides of the main signal transmission path that functions to provide respective pass-bands, two pairs of unequal-length, complementary slot lines $((L_{1t}, L_{1t}), (L_a, L_a))$ that are placed in outer ground planes of a strip-line structure;

wherein each open stub of the two pairs of said open stubs $((L_{1b}, L_{1b}), (L_{2b}, L_{2b}))$ is associated with a corresponding complementary slot line of the two pairs of said complementary slot lines $((L_{1t}, L_{1t}), (L_{2t}, L_{2t}))$ thereby forming a multilayer structure;

wherein each of the two pairs of said open stubs $((L_{1b}, L_{1b}), (L_{2b}, L_{2b}))$ and each of the two pairs of said complementary slot lines $((L_{1t}, L_{1t}), (L_{2t}, L_{2t}))$ has a parallel portion and a non-parallel portion, each parallel portion of the two pairs of said open stubs $((L_{1b}, L_{1b}), (L_{2b}, L_{2b}))$ and the two pairs of said complementary slot lines $((L_{1t}, L_{1t}), (L_{2t}, L_{2t}))$ has an unequal-length; each non-parallel portion of the two pairs of said open stubs $((L_{1b}, L_{1b}), (L_{2b}, L_{2b}))$ and the two pairs of said complementary slot lines $((L_{1t}, L_{1t}), (L_{2t}, L_{2t}))$ cross and are connected at a same location.

3. A basic cell for tuning a signal propagation delay time of a signal propagating from a source end (1) to an output load (5), consisting of a main signal transmission path (2) connected between the source end and the output load, two pairs of open stubs $((L_{1b}, L_{1b}), (L_{2b}, L_{2b}))$ placed on two sides of the main signal transmission path, two pairs of complementary slot lines $((L_{1t}, L_{1t}), (L_{2t}, L_{2t}))$ that are placed in a ground plane of a microstrip structure;

wherein each open stub of the two pairs of said open stubs $((L_{1b}, L_{1b}), (L_{2b}, L_{2b}))$ is associated with a corresponding complementary slot line of the two pairs of said complementary slot lines $((L_{1t}, L_{1t}), (L_{2t}, L_{2t}))$ thereby forming a multilayer structure;

wherein each of the two pairs of said open stubs $((L_{1b}, L_{1b}), (L_{2b}, L_{2b}))$ and each of the two pairs of said complementary slot lines $((L_{1t}, L_{1t}), (L_{2t}, L_{2t}))$ has a parallel portion and a non-parallel portion, each parallel portion of the two pairs of said open stubs $((L_{1b}, L_{1b}), (L_{2b}, L_{2b}))$ and the two pairs of said complementary slot lines $((L_{1t}, L_{1t}), (L_{2t}, L_{2t}))$ has an unequal-length; each non-parallel portion of the two pairs of said open stubs $((L_{1b}, L_{1b}), (L_{2b}, L_{2b}))$ and the two pairs of said complementary slot lines $((L_{1t}, L_{1t}), (L_{2t}, L_{2t}))$ cross and are connected at a same location.

4. The basic cell according to claim 1, where respective characteristic impedances $Z_{1b}$, $Z_{2b}$ with corresponding electrical lengths $\theta_1$, $\theta_2$ ($\theta_1 \neq \theta_2$) of the two pairs of open stubs satisfy:

$$Z_{1b} \cot \theta_1 + Z_{2b} \cot \theta_2 = 0$$

in an operating frequency band.

5. The basic cell according to claim 1, wherein the main signal transmission path (2) and the two pairs of open stubs $((L_{1b}, L_{1b}), (L_{2b}, L_{2b}))$ are conductor printed wires in a signal layer (11) of a printed circuit board, and the two pairs of complementary slot lines $((L_{1t}, L_{1t}), (L_{2t}, L_{2t}))$ are line areas in the ground plane (13) where metal conductor from the ground plane is removed.

6. The basic cell according to claim 1, wherein a cascade connection of a plurality of the basic cells using segments $Z_0, Z_1, \ldots, Z_{n-1}, Z_n$ (n is a positive integer) to form a group delay line system.

* * * * *